US010930141B2

(12) United States Patent
De Paz Alberola et al.

(10) Patent No.: US 10,930,141 B2
(45) Date of Patent: Feb. 23, 2021

(54) SYSTEM AND METHOD FOR INDICATING BUILDING FIRE DANGER RATINGS

(71) Applicant: Carrier Corporation, Palm Beach Gardens, FL (US)

(72) Inventors: Rodolfo De Paz Alberola, Alicante (ES); Berta Carballido Villaverde, Leon (ES)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/493,088

(22) PCT Filed: Mar. 15, 2018

(86) PCT No.: PCT/US2018/022585
§ 371 (c)(1),
(2) Date: Sep. 11, 2019

(87) PCT Pub. No.: WO2018/170229
PCT Pub. Date: Sep. 20, 2018

(65) Prior Publication Data

US 2020/0066140 A1 Feb. 27, 2020

Related U.S. Application Data

(60) Provisional application No. 62/471,638, filed on Mar. 15, 2017.

(51) Int. Cl.
*G08B 29/00* (2006.01)
*G08B 29/18* (2006.01)
(Continued)

(52) U.S. Cl.
CPC ..... *G08B 29/188* (2013.01); *G08B 17/117* (2013.01); *G08B 21/02* (2013.01)

(58) Field of Classification Search
CPC ..... G08B 29/188; G08B 17/117; G08B 21/02
See application file for complete search history.

(56) References Cited

U.S. PATENT DOCUMENTS 7,026,947 B2 4/2006 Faltesek et al.
8,614,633 B1 12/2013 Lear et al.
(Continued)

FOREIGN PATENT DOCUMENTS

EP 2709054 A1 3/2014
KR 20020083036 A 11/2002
(Continued)

OTHER PUBLICATIONS

Mike Price; Fire Mapping; http://www.esri.com/library/ebooks/fire-mapping.pdf; May 2012; 1-60 pages.
(Continued)

*Primary Examiner* — Phung Nguyen
(74) *Attorney, Agent, or Firm* — Cantor Colburn LLP

(57) ABSTRACT

A system for determining fire danger within a building composed of a plurality of building zones comprises: a human presence detector configured to detect a human presence measurement; a fire detector configured to detect a fire measurement; a gas detector configured to detect gas measurement; a storage device to store at least one of an evacuations plan, flammable material index, and human movement prediction model; a fire danger management system coupled to storage device, the fire danger management system including: a fire danger rating generation module to determine a fire danger rating for each building zone in response to at least one of the evacuations plan, flammable material index, and human movement prediction model; and a fire danger index generation module to determine a fire danger index for each building zone in response
(Continued)

to at least one of the fire danger rating, human presence measurement, fire measurement, and gas measurement.

15 Claims, 2 Drawing Sheets

(51) Int. Cl.
*G08B 17/117* (2006.01)
*G08B 21/02* (2006.01)

(56) References Cited

U.S. PATENT DOCUMENTS

| | | | | |
|---|---|---|---|---|
| 9,898,912 | B1 * | 2/2018 | Jordan, II | G05B 15/02 |
| 10,026,279 | B1 * | 7/2018 | Beller | G08B 25/10 |
| 2003/0125998 | A1 | 7/2003 | McKenney et al. | |
| 2005/0128071 | A1 | 6/2005 | Faltesek | |
| 2007/0279210 | A1 | 12/2007 | Li et al. | |
| 2008/0248450 | A1 | 10/2008 | Li et al. | |
| 2010/0131202 | A1 | 5/2010 | Dannevik et al. | |
| 2011/0112660 | A1 * | 5/2011 | Bergmann | G08B 17/00 700/29 |
| 2011/0295624 | A1 | 12/2011 | Chapin et al. | |
| 2012/0047083 | A1 * | 2/2012 | Qiao | G08B 21/02 705/325 |
| 2012/0276517 | A1 | 11/2012 | Banaszuk et al. | |
| 2014/0132409 | A1 | 5/2014 | Billman et al. | |
| 2014/0244318 | A1 | 8/2014 | Drake et al. | |
| 2014/0290103 | A1 * | 10/2014 | Kyberd | G08B 5/28 40/466 |
| 2015/0348220 | A1 * | 12/2015 | Sharma | G01C 21/206 705/324 |
| 2017/0109981 | A1 * | 4/2017 | Joseph | G08B 7/062 |
| 2019/0228631 | A1 * | 7/2019 | Stinson | G08B 21/0269 |

FOREIGN PATENT DOCUMENTS

| | | | |
|---|---|---|---|
| KR | 20110023609 | A | 3/2011 |
| KR | 20150089313 | A | 8/2015 |
| SU | 1648505 | A1 | 5/1991 |
| WO | 2010034547 | A1 | 4/2010 |

OTHER PUBLICATIONS

Notification of Transmittal of the International Search Report for International Application No. PCT/US2018/022585; dated Jun. 12, 2018; Report Received Date: Jun. 14, 2018; 6 pages.

Written Opinion of the International Searching Authority for International Application No. PCT/US2018/022585; dated Jun. 12, 2018; Report Received Date: Jun. 14, 2018; 8 pages.

* cited by examiner

SYSTEM AND METHOD FOR INDICATING BUILDING FIRE DANGER RATINGS

CROSS-REFERENCE TO RELATED APPLICATIONS

This application is a National Stage of International Application No. PCT/US2018/022585 filed Mar. 15, 2018, which claims priority to U.S. Provisional Patent Application Ser. No. 62/471,638 filed Mar. 15, 2017, both of which are incorporated herein by reference in their entirety.

BACKGROUND

The embodiments herein generally relate to fire detections systems and more specifically, the fire detection systems within buildings.

Typically, building fire alarm systems and smoke detectors inform a local controller to trigger an alarm as well as suppression (i.e., water sprinklers) and egress systems (visual and audible signals) in order to stop fire from spreading and aid building occupants' evacuation. Some building systems also report the event of fire to a remote central station. This central station can interrogate one or more building systems and combine the received information to provide a more detailed report when contacting emergency services. These reports describe the alarm type, zone, and activated detector but typically do not provide much more information regarding the danger of the fire. A more comprehensive and accurate analysis of the fire is desired.

BRIEF DESCRIPTION

According to one embodiment, a system for determining fire danger within a building composed of a plurality of building zones is provided. The system comprising: a human presence detector configured to detect a human presence measurement in one or more building zones; a fire detector configured to detect a fire measurement in one or more building zones; a gas detector configured to detect a gas measurement in one or more building zones; a storage device to store at least one of an evacuations plan, a flammable material index, and a human movement prediction model; a fire danger management system coupled to the storage device, the fire danger management system including: a fire danger rating generation module to determine a fire danger rating for each building zone in response to at least one of the evacuations plan, the flammable material index, and the human movement prediction model; and a fire danger index generation module to determine a fire danger index for each building zone in response to at least one of the fire danger rating, the human presence measurement, the fire measurement, and the gas measurement.

In addition to one or more of the features described above, or as an alternative, further embodiments of the system may include where the fire danger index generation module is configured to compile a fire danger building map in response to the fire danger index for each building zone.

In addition to one or more of the features described above, or as an alternative, further embodiments of the system may include where the fire danger management system is configured to transmit the fire danger index for each building zone to a user device.

In addition to one or more of the features described above, or as an alternative, further embodiments of the system may include where the fire danger management system is configured to activate an alarm when the fire danger index is greater than a selected value.

In addition to one or more of the features described above, or as an alternative, further embodiments of the system may include where the fire danger management system is configured to determine an overall building fire danger index in response to the fire danger index for each building zone.

According to another embodiment, a method of determining fire danger within a building composed of a plurality of building zones, the method comprising: detecting a human presence measurement in one or more building zones; detecting a fire measurement in one or more building zones; detecting a gas measurement in one or more building zones; storing, using a storage device, at least one of an evacuations plan, a flammable material index, and a human movement prediction model; analyzing, using a fire danger management system, at least one of the human presence measurement, the fire measurement, the gas measurement, the evacuations plan, the flammable material index, and the human movement prediction model, the fire danger management system coupled to the storage device, the requirement management system including: a fire danger rating generation module to determine a fire danger rating for each building zone in response to at least one of the evacuations plan, the flammable material index, and the human movement prediction model; and a fire danger index generation module to determine a fire danger index for each building zone in response to at least one of the fire danger rating, the human presence measurement, the fire measurement, and the gas measurement.

In addition to one or more of the features described above, or as an alternative, further embodiments of the method may include compiling, using the fire danger index generation module, a fire danger building map in response to the fire danger index for each building zone.

In addition to one or more of the features described above, or as an alternative, further embodiments of the method may include transmitting, using the fire danger management system, the fire danger index for each building zone to a user device.

In addition to one or more of the features described above, or as an alternative, further embodiments of the method may include activating an alarm when the fire danger index is greater than a selected value.

In addition to one or more of the features described above, or as an alternative, further embodiments of the method may include determining, using the fire danger management system, an overall building fire danger index in response to the fire danger index for each building zone.

According to another embodiment, a computer program product tangibly embodied on a computer readable medium, the computer program product including instructions that, when executed by a processor, cause the processor to perform operations comprising: detecting a human presence measurement in one or more building zones; detecting a fire measurement in one or more building zones; detecting a gas measurement in one or more building zones; storing, using a storage device, at least one of an evacuations plan, a flammable material index, and a human movement prediction model; and analyzing, using a fire danger management system, at least one of the human presence measurement, the fire measurement, the gas measurement, the evacuations plan, the flammable material index, and the human movement prediction model, the fire danger management system coupled to the storage device, the requirement management system including: a fire danger rating generation module to determine a fire danger rating for each building zone in response to at least one of the evacuations plan, the flammable material index, and the human movement prediction model; and a fire danger index generation module to determine a fire danger index for each building zone in response to at least one of the fire danger rating, the human presence measurement, the fire measurement, and the gas measurement.

In addition to one or more of the features described above, or as an alternative, further embodiments of the computer program may include where the operations further comprise: compiling, using the fire danger index generation module, a fire danger building map in response to the fire danger index for each building zone.

In addition to one or more of the features described above, or as an alternative, further embodiments of the computer program may include where the operations further comprise: transmitting, using the fire danger management system, the fire danger index for each building zone to a user device.

In addition to one or more of the features described above, or as an alternative, further embodiments of the computer program may include where the operations further comprise: activating an alarm when the fire danger index is greater than a selected value.

In addition to one or more of the features described above, or as an alternative, further embodiments of the computer program may include where the operations further comprise: determining, using the fire danger management system, an overall building fire danger index in response to the fire danger index for each building zone.

Technical effects of embodiments of the present disclosure include a providing up-do-date analysis of the risk associated with a building fire using existing building maps, planned exit routes, flammable materials indexes, and continuously updated data from one or more sensors including fire detectors, gas detectors, and human presence detectors.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
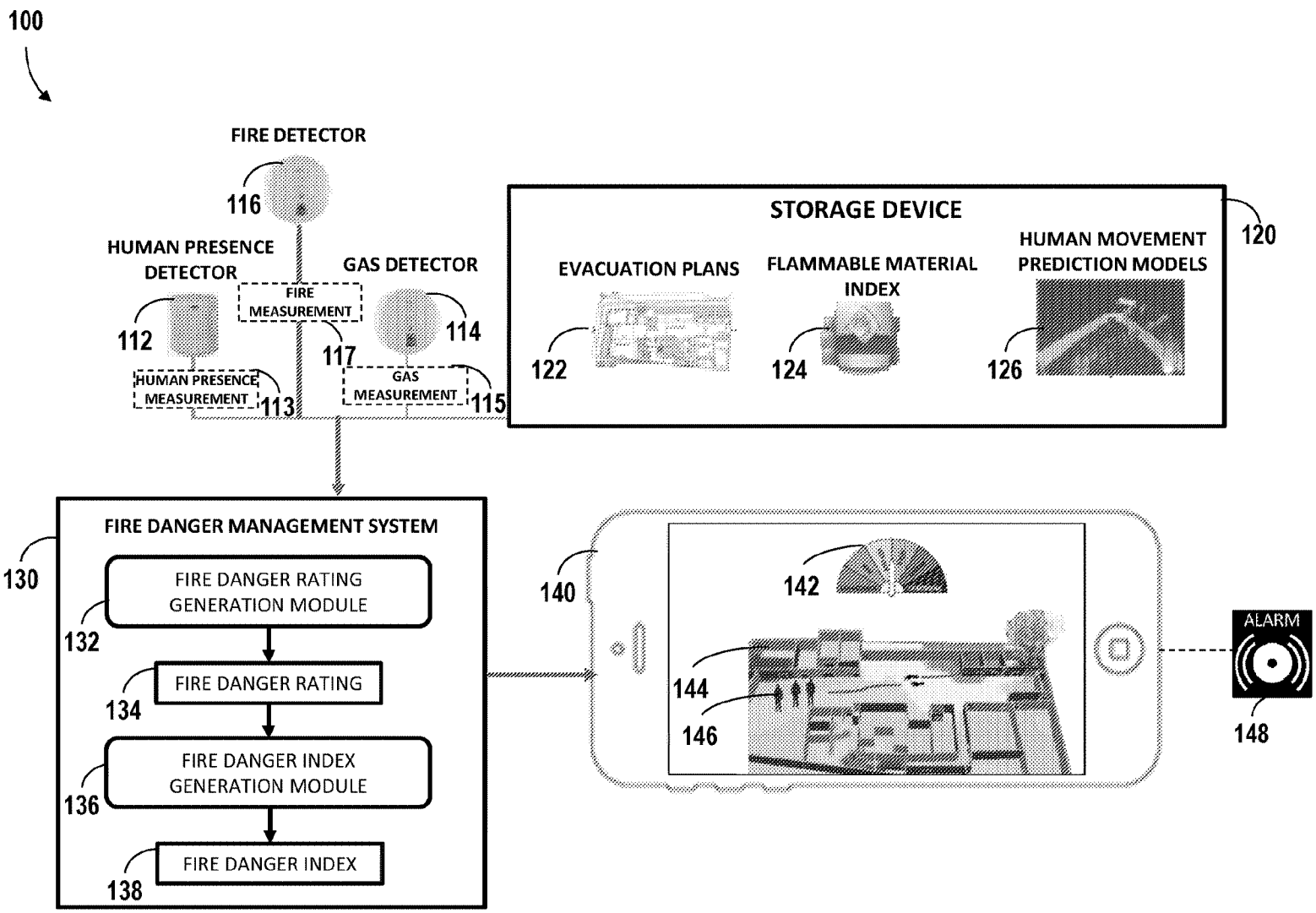
FIG. 1 is a schematic illustration of system for determining fire danger within a building composed of a plurality of building zones, according to an embodiment of the present disclosure.

Referring to FIG. 1, various embodiments of the present disclosure are illustrated. FIG. 1 shows a schematic illustration of a system 100 for analyzing fire danger within a building composed of a plurality of building zones. In an embodiment each floor of a building may qualify as a zone and/or each floor may be broken up in to multiple zones. The system 100 comprises a human presence detector 112, a fire detector 116, a gas detector 114, a storage device 120, and a fire danger management system 130.

The human presence detector 112 is configured to detect a human presence measurement 113 in one or more building zones. A single human presence detector 112 or multiple human presence detectors 112 may be used. The human presence measurement 113 may indicate how many human beings are present in a particular building zone or may provide a binary indication Yes/No to the presence of a human being in a particular zone. The human presence detector 112 may use a variety of ranging sensors and/or presence detection devices to detect human beings such as, for example, a visual detection device, a laser detection device, a thermal image detection device, a depth detection device, a motion detection device, an odor detection device, RADAR, and ultrasonic sensor. The human presence detector 112 is in communication with the fire danger management system 130 and transmits the human presence measurement 113 for each zone to the fire damage management system.

The fire detector 116 is configured to detect a fire measurement 117 in one or more building zones. A single fire detector 116 or multiple fire detectors 116 may be used. The fire measurement 117 may indicate the intensity of the fire or may provide a binary indication (i.e. Yes/No) to the presence of a fire in a particular zone. The fire detector 116 is in communication with the fire danger management system 130 and transmits the fire measurement 117 to the fire damage management system 130. The gas detector 114 is configured to detect a gas measurement 115 in one or more building zones. A single gas detector 114 or multiple gas detectors 114 may be used. The gas measurement 115 may indicate the concentration of a hazardous gas or the gas measurement 115 may provide a binary indication (i.e. Yes/No) of the presence of a hazardous gas. The gas detector 114 may also indicate the type of gas present. The gas detector 114 is in communication with the fire damage management system 130 and transmits the gas measurement 115 to the fire damage management system 130.

The storage device 120 may be but is not limited to a random access memory (RAM), read only memory (ROM), or other electronic, optical, magnetic or any other computer readable medium. The storage device 120 stores at least one of an evacuations plan 122, a flammable material index 124, and a human movement prediction model 126. The evacuations plan 122 comprises maps of the building and possible evacuation routes from each building zone. The flammable material index 124 is a record/listing of the flammability of materials located in each building zone. For instance, the flammable material index 124 may indicate that gasoline is stored in a particular building zone or a particular building zone has other highly flammable elements like paper. The human movement prediction models 126 include routes human beings may take to evacuate the building if the fire is located in a particular building zone. The human movement prediction model 126 may indicate a multiplicity of information including but not limited to the number of human beings that may take each route, possible alternative routes, and the dwell time before evacuation.

The fire danger management system 130 is coupled to the storage device 120. The storage device 120 serves as the memory for the fire danger management system 130. The fire danger management system 130 may also include a processor (not shown). The processor may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously.

The fire danger management system includes a fire danger rating generation module 132 and a fire danger index generation module 136. The fire danger rating module 132 determines a fire danger rating 134 for each building zone in response to at least one of the evacuations plan 122, the flammable material index 124, and the human movement prediction model 126. The fire danger rating 134 may be output to a user device 140 for continuous evaluation and improvement. The user device 140 may be a computing device, such as for example a laptop computer, a desktop computer, a tablet, a smart phone, a smart watch, or any other similar computing device known to one of skill in the art. A user of the user device 140 may be an alarm monitoring center, emergency personnel such as a fire rescue team, fire warden, other personnel such as a facility manager, and/or an employee working at a location in the building.

Advantageously, having a the fire danger rating 134 prior to an actual fire may promote improvement to each building zone to reduce the fire danger rating 134, such as, for example removing highly flammable material. The fire danger rating 134 may display severity as a number rating or "step" rating system 142 that includes levels, such as, for example low-Moderate, high, very high, severe, extreme, and catastrophic. The fire danger rating 134 may also be displayed as a fire danger building map 144. The fire danger rating generation module 132 is configured to compile a fire danger building map 144 in response to the fire danger rating for each building zone. The fire danger building map 144 may use colors to display different fire danger ratings 134. For instance, red may indicate a high fire danger rating 134 while green may indicate a low fire danger rating 134. The fire danger building map 144 may use other visual, audio, or physical indicators to display different fire danger ratings 134, such as numbers, audio, or vibration such as haptic feedback.

The fire danger index generation module determines a fire danger index 138 for each building zone in response to at least one of the fire danger rating 134, the human presence measurement 113, the fire measurement 117, and the gas measurement 115. The fire danger index 138 may be continuously updated with measurements from the human presence detector 112, the fire detector 116, and the gas detector 114. Similar to the fire danger rating 134, the fire danger index 138 may display severity as a number rating or "step" rating system 142 that includes levels, such as, for example, low-moderate, high, very high, severe, extreme, and catastrophic. However, unlike the fire danger rating 134, the fire danger index 138 is updated continuously because it is based on real-time continuous readings from the human presence detector 112, the fire detector 116, and the gas detector 114. The fire danger index 138 may be transmitted to the user device 140 for evaluation. As mentioned above a user of the user device 140 may be an alarm monitoring center, emergency personnel such as a fire rescue team, fire warden, or other personnel such as a facility manager, and/or an employee working at a location in the building. Advantageously, an employee may find the fire danger index 138 useful during an evacuation, as the employee tries to find the safest route out of the building.

The fire danger index 138 may also be displayed as a fire danger building map 144. The fire danger index generation module 136 is configured to compile a fire danger building map 144 in response to the fire danger index 138 for each building zone. The fire danger building map 144 may use colors to display different fire danger indexes 138, and may use other visual, audio, or physical indicators to display different fire danger indexes 138, such as numbers, audio, or vibration such as haptic feedback. For instance, red may indicate a high fire danger index 138 while green may indicate a low fire danger index 138. The fire danger building map 144 updates continuously based on the continuously updating fire danger index 138. Advantageously, having a fire danger building map 144 that updates continuously on a user device 140 may give a fire rescue team up-to-date situational awareness of the fire prior to entering the building and while in the building. The fire danger building map 144 may also indicate where human beings 146 are present in each building zone. Additionally, the fire danger management system 130 is configured to activate an alarm 148 when the fire danger index 138 is greater than a selected value. For instance, the alarm 148 may activate on the user device when fire danger index 138 is too high in a particular building zone and the fire rescue team must evacuate the rescue zone. The alarm 148 may be audible and/or visual. The fire danger management system 130 may also be configured to determine an overall building fire danger index in response to the fire danger index 138 for each building zone. Advantageously, an overall building fire danger index may help the fire rescue team determine whether to entire a building at all or which building to enter first if there is a choice among multiple buildings.

Figure 2:
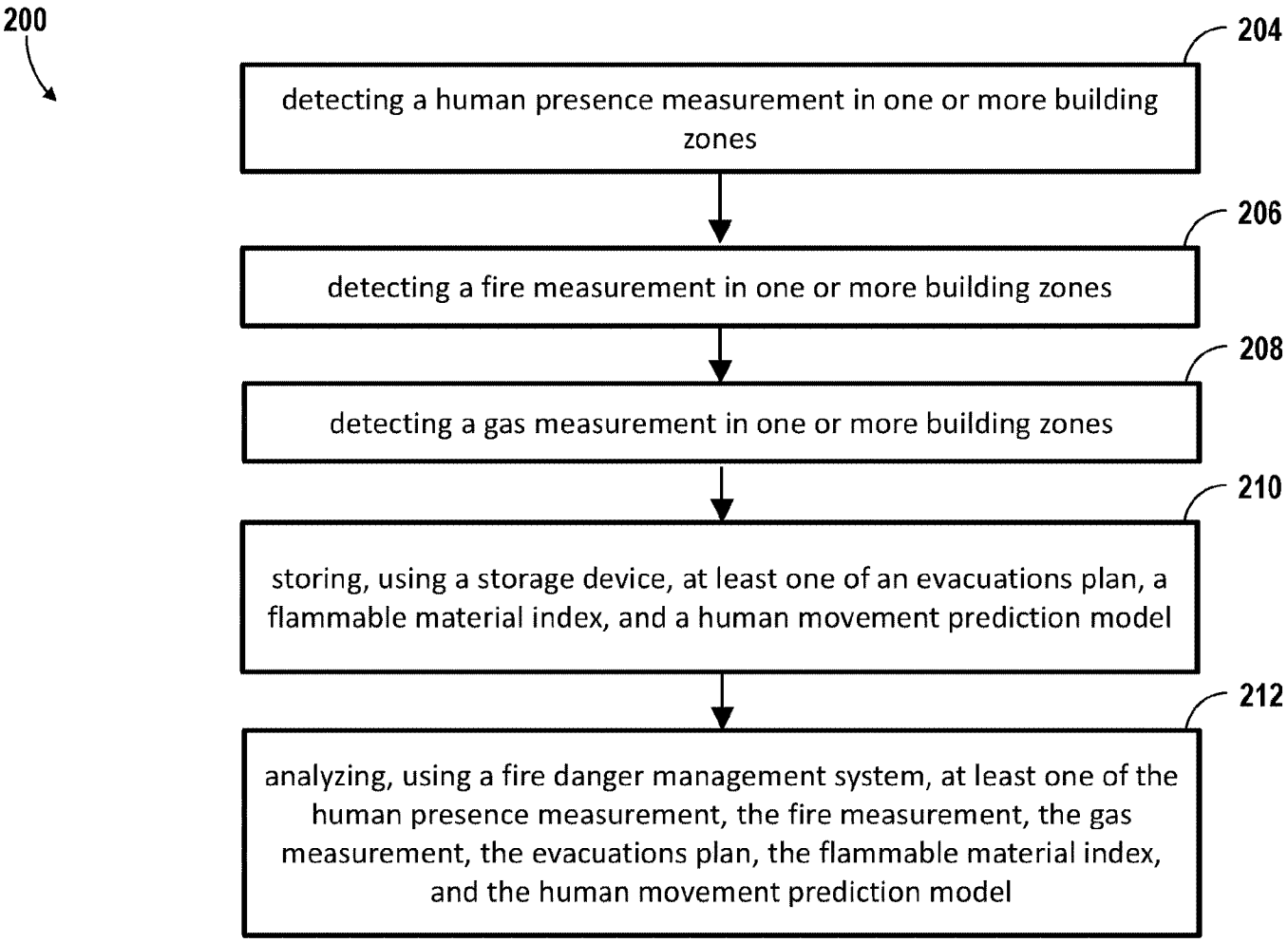
FIG. 2 is a flow diagram illustrating a method of determining fire danger within a building composed of a plurality of building zones, according to an embodiment of the present disclosure.

Turning now to FIG. 2 while continuing to reference FIG. 1, FIG. 2 shows a flow diagram illustrating a method 200 of determining fire danger within a building composed of a plurality of building zones, according to an embodiment of the present disclosure. At block 204, a human presence detector 112 detects a human presence measurement 113 in one or more building zones. At block 206, a fire detector 116 detects a fire measurement 117 in one or more building zones. At block 208, a gas detector 114 detects a gas measurement 115 in one or more building zones. At block 210, a storage device 120 stores at least one of an evacuations plan 122, a flammable material index 124, and a human movement prediction model 126. At block, 212, a fire danger management system, coupled to the storage device 120, analyzes at least one of the human presence measurement 113, the fire measurement 117, the gas measurement 115, the evacuations plan 122, the flammable material index 124, and the human movement prediction model 126. As mentioned above, the fire danger management system 130 comprises a fire danger rating generation module 132 and a fire danger index generation module 136. The fire danger rating generation module 132 determines a fire danger rating 134 for each building zone in response to at least one of the evacuations plan 122, the flammable material index 124, and the human movement prediction model 126. The fire danger index generation module 136 determines a fire danger index 138 for each building zone in response to at least one of the fire danger rating 134, the human presence measurement 113, the fire measurement 117, and the gas measurement 115.

As described above, embodiments can be in the form of processor-implemented processes and devices for practicing those processes, such as a processor. Embodiments can also be in the form of computer program code containing instructions embodied in tangible media, such as floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the exemplary embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A system for determining fire danger within a building composed of a plurality of building zones, the system comprising:

a human presence detector configured to detect a human presence measurement in one or more building zones;

a fire detector configured to detect a fire measurement in one or more building zones;

a gas detector configured to detect a gas measurement in one or more building zones;

a storage device to store at least one of an evacuations plan, a flammable material index, and a human movement prediction model;

a fire danger management system coupled to the storage device, the fire danger management system including:

a fire danger rating generation module to determine a fire danger rating for each building zone in response to at least one of the evacuations plan, the flammable material index, and the human movement prediction model; and a fire danger index generation module to determine a fire danger index for each building zone in response to at least one of the fire danger rating, the human presence measurement, the fire measurement, and the gas measurement, wherein the fire danger index displays severity as a number rating or step rating system that includes levels.

2. The system of claim 1, wherein:

the fire danger index generation module is configured to compile a fire danger building map in response to the fire danger index for each building zone.

3. The system of claim 1, wherein:

the fire danger management system is configured to transmit the fire danger index for each building zone to a user device.

4. The system of claim 1, wherein:

the fire danger management system is configured to activate an alarm when the fire danger index is greater than a selected value.

5. The system of claim 1, wherein:

the fire danger management system is configured to determine an overall building fire danger index in response to the fire danger index for each building zone.

6. A method of determining fire danger within a building composed of a plurality of building zones, the method comprising:

detecting a human presence measurement in one or more building zones;

detecting a fire measurement in one or more building zones;

detecting a gas measurement in one or more building zones;

storing, using a storage device, at least one of an evacuations plan, a flammable material index, and a human movement prediction model;

analyzing, using a fire danger management system, at least one of the human presence measurement, the fire measurement, the gas measurement, the evacuations plan, the flammable material index, and the human movement prediction model, the fire danger management system coupled to the storage device, the requirement management system including:

a fire danger rating generation module to determine a fire danger rating for each building zone in response to at least one of the evacuations plan, the flammable material index, and the human movement prediction model; and a fire danger index generation module to determine a fire danger index for each building zone in response to at least one of the fire danger rating, the human presence measurement, the fire measurement, and the gas measurement, wherein the fire danger index displays severity as a number rating or step rating system that includes levels.

7. The method of claim 6, further comprising:

compiling, using the fire danger index generation module, a fire danger building map in response to the fire danger index for each building zone.

8. The method of claim 6, further comprising:

transmitting, using the fire danger management system, the fire danger index for each building zone to a user device.

9. The method of claim 6, further comprising:

activating an alarm when the fire danger index is greater than a selected value.

10. The method of claim 6, further comprising:

determining, using the fire danger management system, an overall building fire danger index in response to the fire danger index for each building zone.

11. A computer program product tangibly embodied on a non-transitory computer readable medium, the computer program product including instructions that, when executed by a processor, cause the processor to perform operations comprising:

detecting a human presence measurement in one or more building zones;

detecting a fire measurement in one or more building zones;

detecting a gas measurement in one or more building zones;

storing, using a storage device, at least one of an evacuations plan, a flammable material index, and a human movement prediction model; and analyzing, using a fire danger management system, at least one of the human presence measurement, the fire measurement, the gas measurement, the evacuations plan, the flammable material index, and the human movement prediction model, the fire danger management system coupled to the storage device, the requirement management system including:

a fire danger rating generation module to determine a fire danger rating for each building zone in response to at least one of the evacuations plan, the flammable material index, and the human movement prediction model; and a fire danger index generation module to determine a fire danger index for each building zone in response to at least one of the fire danger rating, the human presence measurement, the fire measurement, and the gas measurement, wherein the fire danger index displays severity as a number rating or step rating system that includes levels.

12. The computer program of claim 11, wherein the operations further comprise:

compiling, using the fire danger index generation module, a fire danger building map in response to the fire danger index for each building zone.

13. The computer program of claim 11, wherein the operations further comprise:

transmitting, using the fire danger management system, the fire danger index for each building zone to a user device.

14. The computer program of claim 11, wherein the operations further comprise:

activating an alarm when the fire danger index is greater than a selected value.

15. The computer program of claim 11, wherein the operations further comprise:

determining, using the fire danger management system, an overall building fire danger index in response to the fire danger index for each building zone.

* * * * *